US005104346A

United States Patent [19]

Smrt

[11] Patent Number: 5,104,346

[45] Date of Patent: Apr. 14, 1992

[54] ANIMATION METHOD AND DEVICE

[76] Inventor: Thomas J. Smrt, 10014 South Grant Hwy., Marengo, Ill. 60152

[21] Appl. No.: 482,146

[22] Filed: Feb. 20, 1990

[51] Int. Cl.[5] ..... A63H 13/00; G09F 19/08

[52] U.S. Cl. ..... 446/199; 446/180; 40/412

[58] Field of Search ..... 446/198, 197, 180, 190, 446/199, 183, 178, 185, 191, 220, 226, 221; 40/412, 422, 477, 439

[56] References Cited

U.S. PATENT DOCUMENTS

| | | | |
|---|---|---|---|
| 2,047,377 | 7/1936 | Liwschutz | 446/190 X |
| 2,698,499 | 1/1955 | Dygon | 446/198 |
| 3,594,942 | 7/1971 | Hollingsworth et al. | 446/198 |
| 4,683,669 | 8/1987 | Greer, Jr. | 446/337 X |
| 4,759,737 | 7/1988 | Ferenczi | 446/183 |

FOREIGN PATENT DOCUMENTS

| | | | |
|---|---|---|---|
| 475405 | 4/1929 | Fed. Rep. of Germany | 446/185 |

*Primary Examiner*—Mickey Yu

*Attorney, Agent, or Firm*—Leydig, Voit & Mayer

[57] ABSTRACT

There now has been discovered a simple, straight-forward apparatus for animating figures through the use of the apparatus and method of the present invention. The apparatus and method employ a plurality of collapsible, fluid chambers, and associated values controlling the fluid pressure in each of the chambers. At least two of the chambers are physically arranged so that the inflation of one such chamber and deflation of the other complimentary chamber causes all or a part of the figure to assume a different spatial position, dependent upon the level of inflation of each of the chambers. Typically, at least two of the chambers are arranged so that the inflation of one such chamber exerts a physical force on the other.

4 Claims, 6 Drawing Sheets

ANIMATION METHOD AND DEVICE

FIELD OF THE INVENTION

This invention relates generally to animated figures and more specifically to an apparatus and method for achieving animation or motion in such figures.

BACKGROUND OF THE INVENTION

Small animated figures such as dolls or figures which are part of music boxes, clocks and the like have existed for hundreds of years. Such animation has classically been achieved through the use of mechanical gearing. In modern times, animation has been achieved through the use of electro-mechanical designs requiring extremely complex electrical circuitry and associated mechanical devices, such as expensive servo-motors and the like. More recently, with the development of amusement and theme parks, the need to animate much larger figures, such as full size human and animal replicates, has arisen.

As the size of the figure to be animated increases, the complexity of the electro-mechanical design requirements grows commensurately. In part, the one approach has been to employ pneumatics to achieve animation of such large figures. However, the resulting animation has been crude, at best, and incapable of duplicating fine motion, such as that demonstrated by a human finger. When dealing with very large figures, the devices needed to effectively animate fine, detailed motion are extremely expensive and require special electrical current, along with complicated control circuitry. Even that solution, however, cannot achieve rapid, realistic motion, as the time necessary for the figure to change from one position to another is limited by the time necessary for servo-motors to reposition themselves.

Further, to realistically animate some figures, the need also arises for the animated character to exhibit a significant degree of strength. An unfortunate drawback of the electro-mechanical means of animating figures, typically, is a lack of ability to exhibit such significant strength.

Because of the complexity of the task, only the largest of companies have been able to afford to design and build large animated figures, which still suffer from the aforementioned shortcomings. Of course, the public visiting theme parks and the like displaying such animated figures have been required to pay higher prices of admission to allow the theme park operator to recoup the high investment costs required to construct the figures used in the park in the first instance.

A need thus exists for a relatively simple means to achieve realistic animation or motion in figures, especially large figures, such as replications of horses, dragons and the like, without the use of expensive, electro-mechanical motors. A need also exists for a means of animating figures in a manner which allows the characters to perform tasks requiring a level of strength and rapidity of motion not capable of being exhibited by figures animated through electro-mechanical servo motors and the like.

SUMMARY OF THE INVENTION

There now has been discovered a simple, straight-forward means for animating figures through the use of the apparatus and method of the present invention. The apparatus and method employ a plurality of collapsible, fluid chambers, and associated means for controlling the fluid pressure in each of said chambers. At least two of said chambers have inflated spatial orientations which cause all or a part of the figure to assume a different position, dependent upon the level of inflation of each of said chambers. In a typical configuration, the chambers are arranged so that the inflation of one such chamber exerts a physical force on the other.

BRIEF DESCRIPTION OF THE DRAWINGS

FIGS. 1A, 1B and 1C show a cut-away view of the arm alone, while FIGS. 1D and 1E show the arm as attached to a torso, along with the associated control equipment.

FIGS. 1A-1 and 1A-2 show inflated "L" shape chamber and inflated straight cylindrical chamber, respectively.

FIGS. 2D, 2E and 2F are sectional views of FIGS. 2A, 2B and 2C, respectively.

DETAILED DESCRIPTION OF THE PREFERRED EMBODIMENTS

Figures 1, 1A:
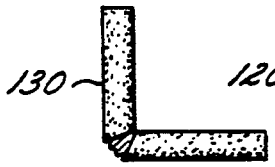

In accordance with the present invention, animation of figures, whether large or small, can be achieved through the use of a simplified device and method. The device can take the form of enumerable specific embodiments, all of which are within the scope of the present invention. All such specific embodiments employ at least two collapsible chambers which are independently connected to a fluid supply means. At least two such chambers are placed in such physical relationship that the inflation of either chamber and deflation of its complimentary chamber, causes an outward movement of the figure. Typically, inflation of one chamber places a force on another, complimentary chamber. Such force tends to cause the collapse of that other chamber.

The collapsible chambers of the present invention may be constructed of any suitable elastic material, such as natural or synthetic rubber, including styrene-butadiene rubber. The composition of the chamber is not critical as long as it is flexible and collapsible over repeated cycles of inflation and deflation.

The collapsible chambers should be as fluid-tight as possible, to minimize the energy necessary to change and maintain the chambers in a state of inflation or deflation. The fluid necessary to cause the inflation or deflation of the chambers likewise is not critical, although for ease and simplicity of design, fabrication, and operation, it is preferred to use air to inflate the chambers. The pressure maintained in the chambers when inflated likewise is not critical and any pressure over atmospheric is desirable, such as from about 2 to about 200 psi. Essentially, there is no limitation upon the amount of pressure which may be employed, as the components of the system may be varied in design to accommodate the desired pressure. The amount of pressure employed to inflate a chamber is directly translatable into the amount of strength which may be exhibited by the animated character. Further, the pressure differential maintained between inflated chambers and deflated chambers is directly translatable into speed. The greater the differential, the more quickly that a given chamber can inflate and a second chamber deflate, allowing the figure to rapidly change in outward appearance.

Preferably, the chambers, when inflated, will be inflated to a pressure from about 20 psi to about 80 psi, more preferably to a pressure of about 50 psi. Likewise, when deflated, the deflated chamber will be maintained at atmospheric pressure or below. Typically, the pressure necessary to operate the system will be supplied from a conventional air compressor, capable of being operated by conventional 110 volt current or even batteries.

When one chamber is inflated, typically that inflated chamber will apply a force to the other, although that force need may not be fully opposing in the sense that full inflation of the one chamber would necessarily cause full collapse of the other. Hence, the force exerted by one chamber against the other also may be tangential, as illustrated in the embodiments discussed below.

To provide for the ability to inflate the chambers, each chamber is placed in fluid communication with a fluid supply means which is capable of supplying fluid thereto through a fluid supply conduit. Respective fluid control means, or valves, control the fluid flow to each of the collapsible chambers. Normally the valves are of the type which are either fully open or fully closed, although in some applications valves capable of being placed in partially open positions may be employed. In typical operation, when the valve to one of the collapsible chambers is placed in a closed position, the valve associated with the opposing chamber is placed in an open position.

The invention will be further illustrated by the Figures discussed below.

FIGS. 1A through 1E show an embodiment of the present invention in which two collapsible chambers 120 and 130 are contained within a flexible exterior sheath 110 which has been shaped to represent a human arm with an attached hand 112. Chamber 120 has an inflated or filled shape of a substantially straight cylinder, while chamber 130 has an inflated or filled shape of an "L". Chamber 120 is fluidly connected to conduit 122 which places chamber 120 in fluid communication with valve 124, which in turn is placed in fluid communication with fluid supply 140 by means of conduit 126. Similarly, chamber 130 is connected to conduit 132 which places chamber 130 in fluid communication with valve 134, which in turn is placed in fluid communication with fluid supply 140 by means of conduit 136.

Chamber 120 is also fluidly connected to conduit 123 which places chamber 120 in fluid communication with valve 125, which in turn is placed in fluid communication with fluid evacuation chamber 150 by means of conduit 127. Similarly, chamber 130 is connected to conduit 133 which places chamber 130 in fluid communication with valve 135, which in turn is placed in fluid communication with fluid evacuation chamber 150 by means of conduit 137. Pump 160 is placed in fluid communication with both fluid supply 140 and fluid evacuation chamber 150 by means of conduits 162 and 164, respectively.

Valves 124, 125, 134 and 135 are connected to actuator means 128, 129, 138 and 139, respectively (not shown). The valves may be electro-mechanical valves which are actuated by electric current, as is well known in the art. Any type of valve may be employed, as well as any actuator means, including electrical, mechanical, pneumatic, or the like.

Figures 1, 1A, 2:
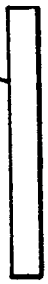
Figure 1A:
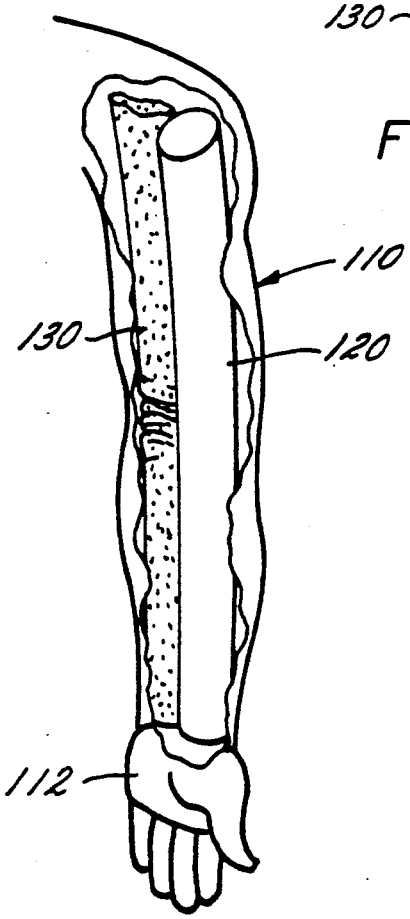
FIGS. 1A, 1B, 1C, 1D and 1E illustrate one embodiment of the present invention for providing animation for the arm of a human figure.
Figure 1C:
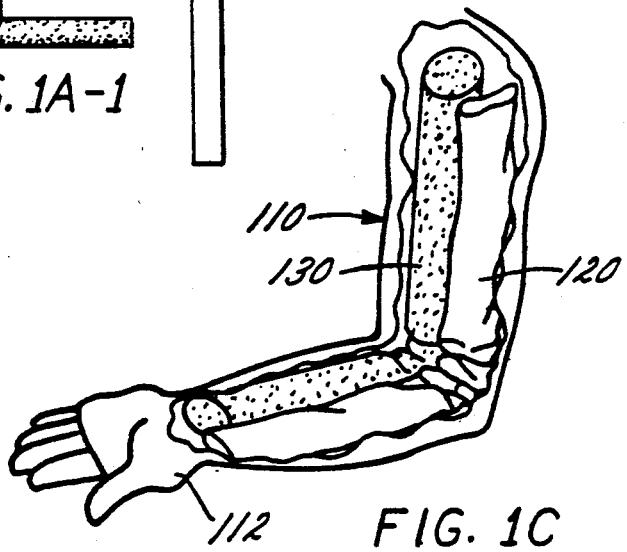
Figure 1B:
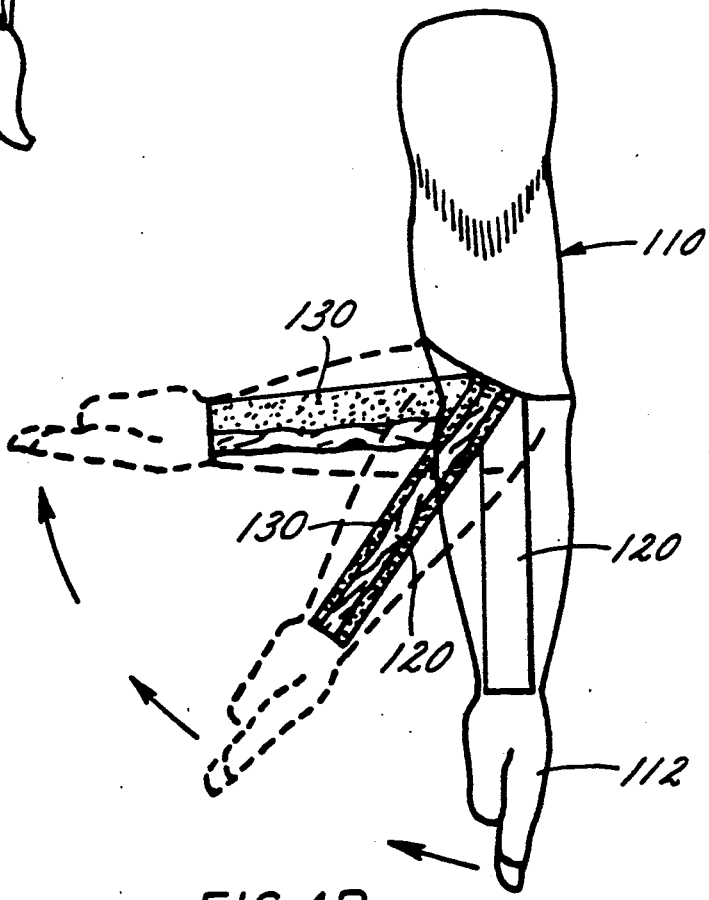
Figure 1D:
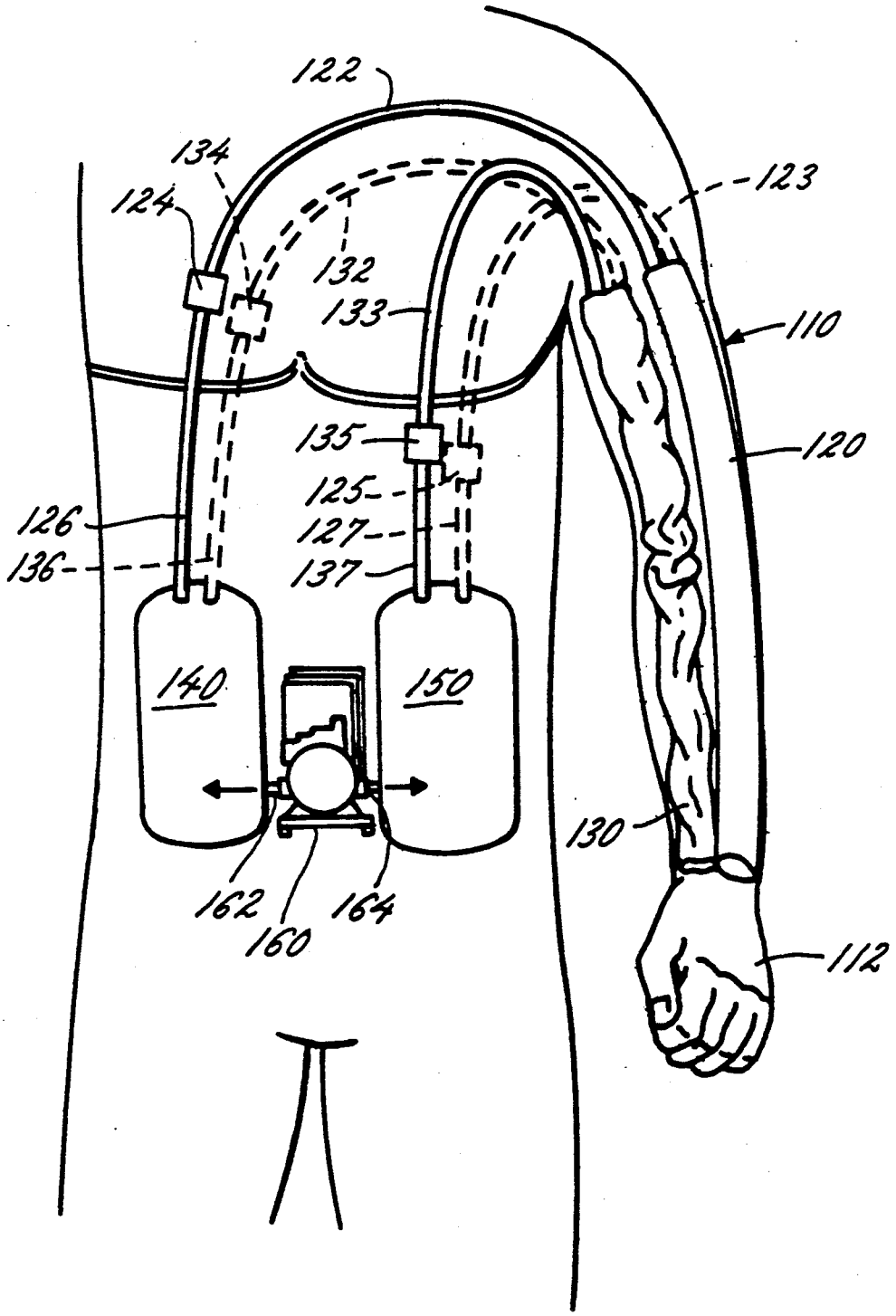

In operation, extension of the arm is achieved by inflating chamber 120 by opening valves 124 and 135 and closing valves 125 and 134, as shown in FIGS. 1A and 1D. In this manner, fluid flows from fluid supply 140 to fully inflate chamber 120, while fluid is drawn from chamber 130 into fluid reservoir 150. Pump 160 is demand activated and supplies pressure, if necessary, to evacuate reservoir 150 and to pressurize fluid supply 140. The speed with which the arm moves from one position to another is directly dependent upon the pressure differential maintained between the fluid supply 140 and the fluid reservoir 150.

Figure 1E:
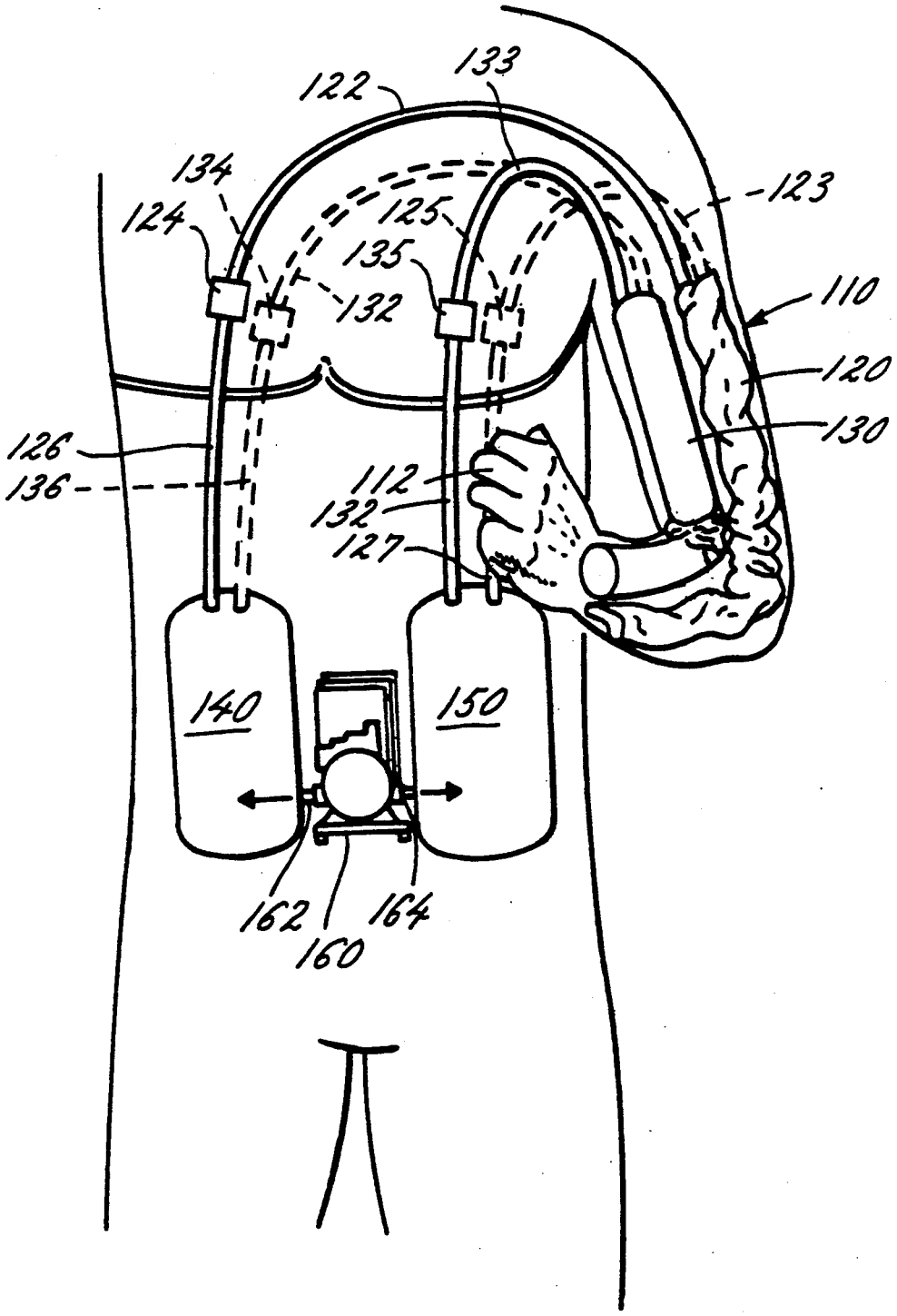

To achieve motion of the arm and movement of the arm to a "bent" configuration, valves 124 and 135 are closed and valves 125 and 134 are opened, causing chamber 120 to be evacuated and chamber 130 to be inflated, as shown in FIGS. 1B and 1E. By controlling the valves to allow both chambers 120 and 130 to become partially filled and partially evacuated, incremental positions between fully extended and fully bent can be achieved, as shown in FIG. 1C.

As can be readily ascertained from FIG. 1, inflation of either chamber 120 or chamber 130 causes the inflated chamber to exert a force on the other chamber, tending to cause collapse of that other chamber. Although FIG. 1 represents a preferred embodiment, other simplified embodiments are also possible, although less desired. Because inflation of either chamber 120 or chamber 130 causes a collapsing force to be exerted, it is not necessary in all instances that the evacuation chamber and associated conduit be employed. Thus, for example, conduits 126 and 136 can be eliminated, which would then allow the fluid, such as air, to escape to the environment, upon the opening of valves 124 or 134, once collapsing pressure is applied by virtue of the inflation of the other chamber.

Figure 2A:
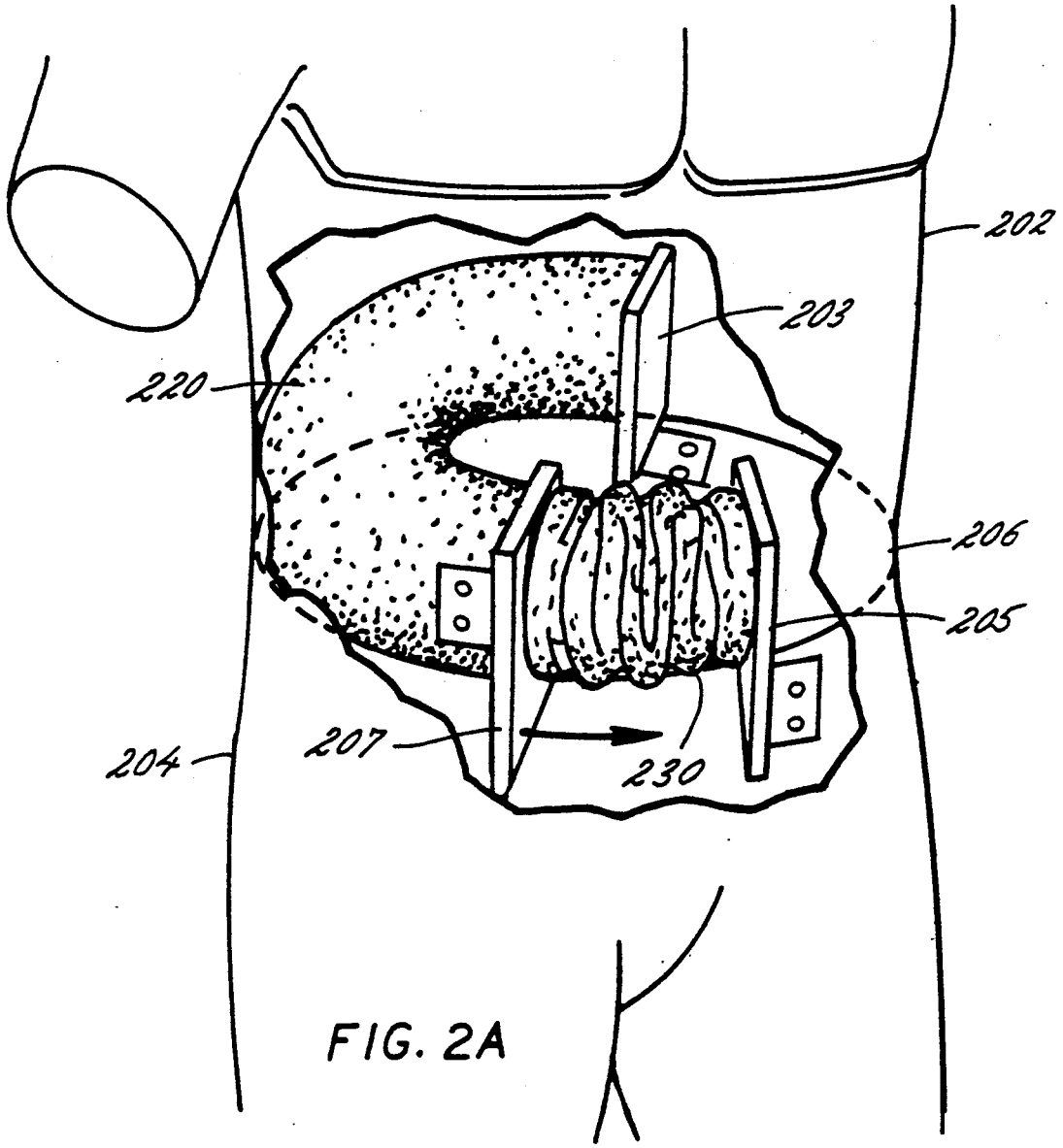
FIGS. 2A, 2B, 2C, 2D, 2E and 2F show an embodiment of the present invention in which rotational animation is achieved for a torso of a human figure.
Figure 2D:
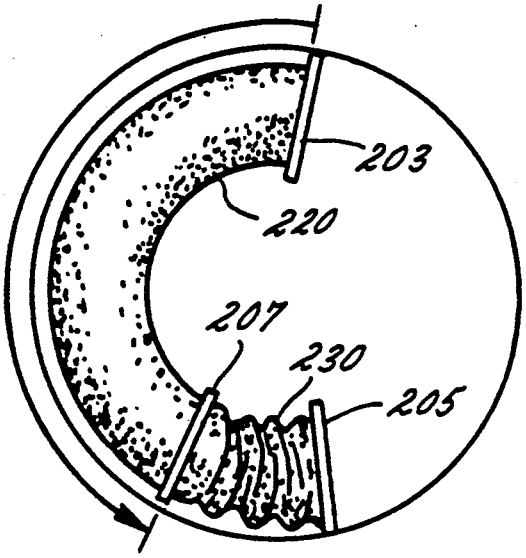
Figure 2B:
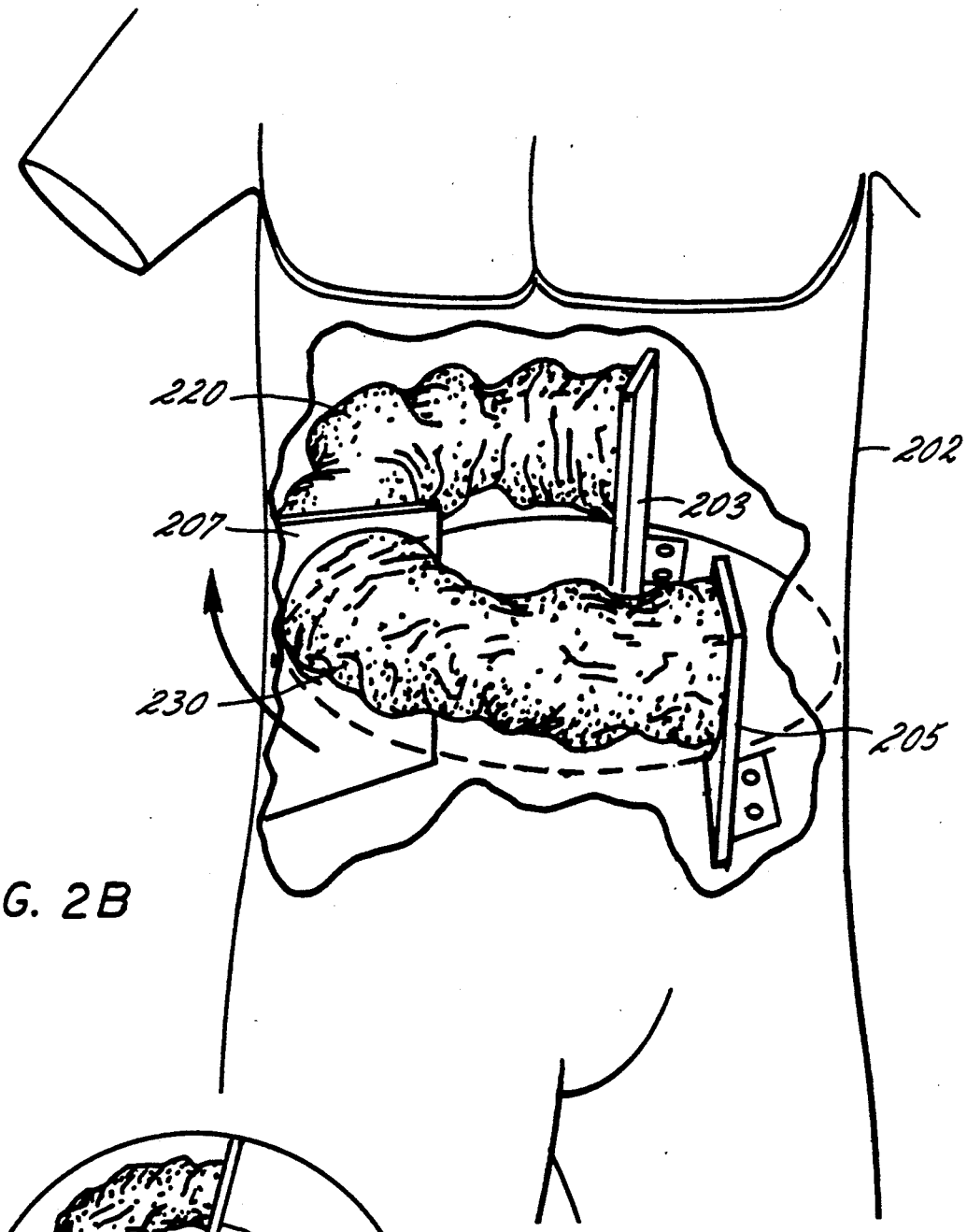
Figure 2E:
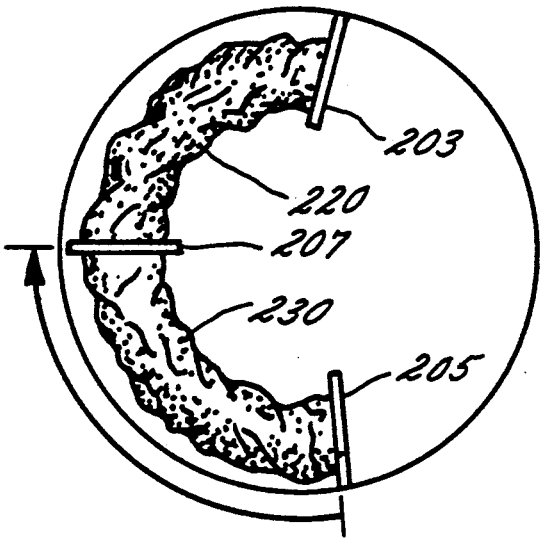
Figure 2C:
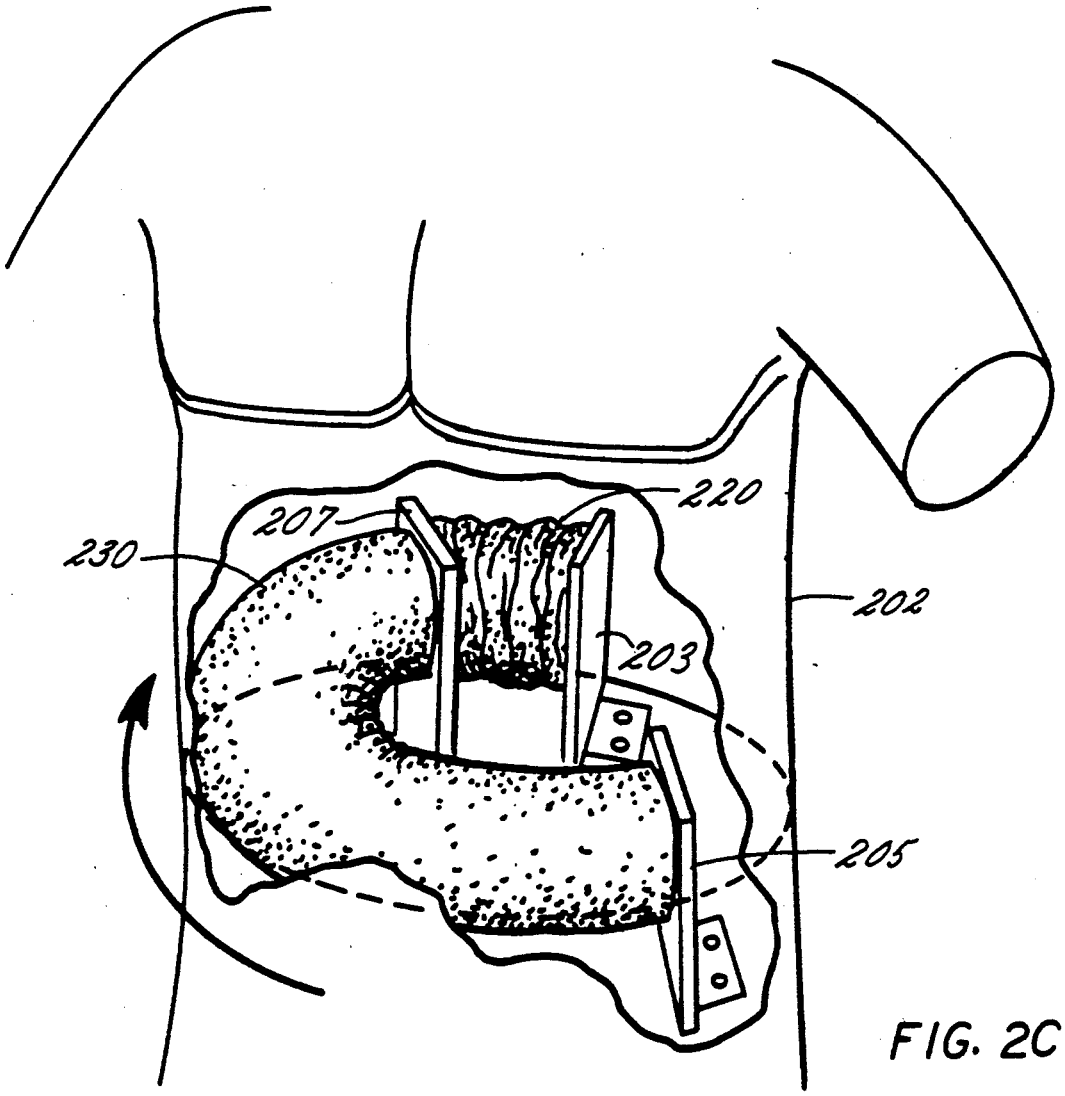
Figure 2F:
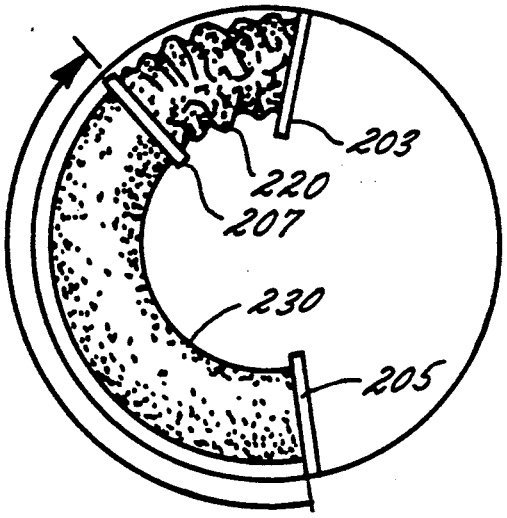

FIGS. 2A through 2F are illustrations of another embodiment of the present invention in which 200 represents, generally, a replication of a human torso having an upper half 202 and a lower half 204. The upper half is rotationally mounted to the lower half at junction 206. Collapsible chambers 220 and 230, when inflated, have the configuration of a segment of a circle and are rigidly mounted at opposite end to the lower half of the torso 204 by means of attaching plates 203 and 205, respectively. The collapsible chambers 220 and 230 are mounted to a common attaching plate 207 which is also rigidly mounted to the upper half of the torso 202. Inflation of chamber 220 causes rotation of the upper half of the torso 202 in a counter-clockwise direction, as shown in FIG. 2A and 2D, while inflation of chamber 230 causes rotation of the upper half of the torso 202 in a clockwise direction, as shown in FIGS. 2C and 2F. The collapsible chambers may be easily placed in fluid communication with a fluid supply source and an evacuation chamber in a manner similar to that shown in FIG. 1. From FIG. 2 it is readily apparent that inflation of either chamber 220 or chamber 230 causes a directly opposing collapsing force to be applied to the other chamber. The pressure differential maintained between the fluid supply and the fluid reservoir sides of the system again controls the speed at which the torso will rotate.

Partial evacuation and partial pressurization of both chambers 220 and 230 causes the upper torso 202 to be rotated to intermediate positions between full clockwise rotation and full counter-clockwise rotation, as shown in FIGS. 2B and 2E.

Although the invention has been specifically described in terms of two collapsible chambers, it is clear that more than two chambers may be employed within the spirit and scope of the present invention, especially if more complicated motion or movement is desired. The present invention should be especially well suited for use in duplicating the complex movements, such as that exhibited by a human hand. Also, because there is no significant limitation upon the pressure which may be employed in the system, high levels of strength may be exhibited by the figures which are animated through use of the present invention.

I claim:

1. An apparatus for attaining motion in an animated figure comprising (1) at least two collapsible, fluid chambers which are capable of being repetitively inflated to a predetermined, desired shape and subsequently deflated, and (2) means for controlling the fluid pressure in each of said chambers, at least two of said chambers being physically arranged so that the inflation of one such chamber and deflation of the other complimentary chamber causes all or a part of the figure to assume a different spatial position, dependent upon the level of inflation of each of said chambers, wherein said chambers are arranged so that the inflation of one such chamber exerts a physical force on the other and wherein the means for controlling the fluid pressure for each of the fluid chambers comprises (1) a first valve, (2) a first conduit which is in fluid communication with said chamber and said first valve, (3) a fluid supply means, (4) a second conduit which is in fluid communication with said fluid supply means and said first valve, (5) a second valve, (6) a third conduit which places said chamber in fluid communication with said second valve, (7) a fluid evacuation chamber, (8) a fourth conduit which is in fluid communication with said fluid evacuation chamber and said second valve, (9) first means for controlling the position of said first valve, and (10) second means for controlling the position of said second valve.

2. An apparatus for attaining motion in an animated figure comprising (1) at least two collapsible, fluid chambers which are capable of being repetitively inflated to a predetermined desired shape and subsequently deflated, and means for controlling the fluid pressure for each of the fluid chambers comprising (1) a first valve, (2) a firs conduit which is in fluid communication with said chamber and said first valve, (3) a fluid supply means, (4) a second conduit which is in fluid communication with said fluid supply means and said first valve, (5) a second valve in fluid communication with said chamber, (6) first means for controlling the position of said first valve and (7) second means for controlling the position of said second valve.

3. An animated figure comprising an apparatus for achieving animation of said figure, said apparatus comprising a collapsible, fluid chamber contained within the body of said figure, which chamber is capable of being repetitively inflated to a predetermined desired shape and subsequently deflated, and means for controlling the fluid pressure in said chamber comprising (1) a first valve, (2) a first conduit which is in fluid communication with said chamber and said first valve, (3) a fluid supply means, (4) a second conduit which is in fluid communication with said fluid supply means and said first valve, (5) a second valve in fluid communication with said chamber, (6) first means for controlling the position of said first valve, and (7) second means for controlling the position of said second valve, the inflation of the chamber causing all or a part of the figure to assume a different spatial position, dependent upon the level of inflation of said chamber.

4. An animated figure having at least one movable region which comprises an exterior sheath having a collapsible, fluid chamber contained within said sheath and in physical contact with the interior of said sheath, said chamber being capable of being repetitively inflated to a predetermined desired shape and subsequently deflated, and means for controlling the fluid pressure in said chamber, the inflation and deflation of the chamber directly causing, without the use of intervening mechanical levers, said sheath to assume a different spatial position, dependent upon the level of inflation of said chamber, wherein the means for controlling the fluid pressure in the chamber comprises (1) a first valve, (2) a first conduit which is in fluid communication with said chamber and said first valve, (3) a fluid supply means, (4) a second conduit which is in fluid communication with said fluid supply means and said first valve, (5) a second valve in fluid communication with said chamber, (6) first means for controlling the position of said first valve (7) and second means for controlling the position of said second valve.

* * * * *